US007918359B2

(12) United States Patent
Paris et al.

(10) Patent No.: US 7,918,359 B2
(45) Date of Patent: Apr. 5, 2011

(54) OPENING DEVICE

(75) Inventors: Alexandre Paris, Oxon (GB); Mark James LeFeuvre, Oxford (GB); Christopher Paul Ramsey, Oxon (GB)

(73) Assignee: Crown, Packaging Technology, Inc., Alsip, IL (US)

( * ) Notice: Subject to any disclaimer, the term of this patent is extended or adjusted under 35 U.S.C. 154(b) by 642 days.

(21) Appl. No.: 11/747,049

(22) Filed: May 10, 2007

(65) Prior Publication Data

US 2007/0262079 A1 Nov. 15, 2007

(30) Foreign Application Priority Data

May 10, 2006 (EP) ..... 06113767

(51) Int. Cl.
*B65D 17/34* (2006.01)
*B65D 51/18* (2006.01)
*B65D 17/50* (2006.01)

(52) U.S. Cl. ..... 220/254.3; 220/254.9; 220/259.1; 220/269

(58) Field of Classification Search ..... 220/269, 220/254.3, 254.4, 255.1, 258.2, 259.1, 254.9
See application file for complete search history.

(56) References Cited

U.S. PATENT DOCUMENTS 3,250,425 A 5/1966 Stec et al.
3,262,612 A 7/1966 Tabor
3,287,053 A 11/1966 Stec et al.
3,386,613 A 6/1968 Traynor
3,406,867 A 10/1968 Westphal et al.
3,447,713 A 6/1969 Stec et al.
3,450,301 A 6/1969 Stec et al.
3,520,440 A 7/1970 Kinnavy et al.
3,705,670 A 12/1972 Douty
3,744,662 A 7/1973 Zundel
3,788,512 A 1/1974 Brahler
3,871,544 A 3/1975 Peyser
3,910,410 A 10/1975 Shaw
3,952,911 A 4/1976 Bozek et al.
4,054,205 A 10/1977 Blow, Jr. et al.
4,098,439 A 7/1978 Blow, Jr. et al.
4,122,970 A * 10/1978 Amabili ..... 220/257.2

(Continued)

FOREIGN PATENT DOCUMENTS

EP 0088185 A1 9/1983

(Continued)

OTHER PUBLICATIONS

U.S. Appl. No. 12/447,576, filed Apr. 28, 2009, Paris.

(Continued)

*Primary Examiner* — Anthony Stashick
*Assistant Examiner* — Niki M Eloshway
(74) *Attorney, Agent, or Firm* — Woodcock Washburn LLP

(57) ABSTRACT

An opening device of plastics material, which is suitable for closing and re-closing of a metal can end, for example. The opening device has two distinct parts: a base plate and a tab, which are joined together by an integral rivet. The opening device is used to close an aperture in the metal panel of a can end by fitting the base plate to the underside of the panel and connecting this to the tab on the top of the panel. A sliding action by pulling or retaining the tab actuates movement of the base plate for opening and reclosing of the closure panel.

22 Claims, 12 Drawing Sheets

U.S. PATENT DOCUMENTS

| | | | | |
|---|---|---|---|---|
| 4,127,221 | A | 11/1978 | Vere | |
| 4,136,797 | A | 1/1979 | Potts | |
| 4,150,777 | A | 4/1979 | Cyr et al. | |
| 4,266,688 | A | 5/1981 | Reid | |
| 4,361,244 | A | 11/1982 | Walter | |
| 4,369,888 | A | 1/1983 | Walter | |
| 4,397,400 | A | 8/1983 | Walter | |
| 4,397,403 | A | 8/1983 | Guimarin | |
| 4,407,423 | A | 10/1983 | Walter | |
| 4,431,110 | A | 2/1984 | Roth | |
| 4,440,310 | A | 4/1984 | Heyn | |
| 4,540,611 | A | 9/1985 | Henderson | |
| 4,576,306 | A | 3/1986 | Kelsey et al. | |
| 4,681,238 | A | 7/1987 | Sanchez | |
| 4,746,032 | A | 5/1988 | Huang | |
| 4,821,912 | A | 4/1989 | Wells | |
| 4,915,290 | A * | 4/1990 | Robichaud et al. | 229/125.08 |
| 4,930,654 | A | 6/1990 | Thibeault et al. | |
| 4,951,835 | A | 8/1990 | DeMars et al. | |
| 5,085,338 | A * | 2/1992 | Inagaki | 220/259.1 |
| 5,148,935 | A | 9/1992 | Lyon | |
| 5,199,591 | A | 4/1993 | Thibeault et al. | |
| 5,199,618 | A | 4/1993 | Reil et al. | |
| 5,242,073 | A | 9/1993 | Willis et al. | |
| 5,335,808 | A | 8/1994 | Lee | |
| 5,351,853 | A | 10/1994 | Shock | |
| 5,622,273 | A | 4/1997 | Kelly | |
| 5,692,633 | A | 12/1997 | Gordon | |
| 5,711,447 | A | 1/1998 | Plester | |
| 5,813,561 | A | 9/1998 | Chang et al. | |
| 5,829,610 | A | 11/1998 | Rohr | |
| 5,947,317 | A | 9/1999 | Hall | |
| 6,065,634 | A | 5/2000 | Brifcani et al. | |
| 6,105,806 | A | 8/2000 | Stasiuk | |
| 6,588,617 | B1 | 7/2003 | Majcen et al. | |
| 6,626,314 | B1 * | 9/2003 | McHenry et al. | 220/254.2 |
| 6,763,963 | B1 * | 7/2004 | Martin | 220/254.2 |
| 7,152,766 | B1 | 12/2006 | Walsh et al. | |
| 7,168,586 | B2 | 1/2007 | Jeon | |
| 7,198,168 | B2 * | 4/2007 | Mizuma | 220/269 |
| 2002/0050493 | A1 | 5/2002 | Ball et al. | |
| 2003/0062370 | A1 | 4/2003 | Ball et al. | |
| 2003/0178433 | A1 | 9/2003 | Adams | |
| 2005/0051553 | A1 | 3/2005 | Li et al. | |
| 2005/0150889 | A1 | 7/2005 | Perra | |
| 2005/0173453 | A1 | 8/2005 | Azodi | |
| 2006/0163253 | A1 * | 7/2006 | Steadman | 220/254.7 |
| 2007/0068943 | A1 * | 3/2007 | Ramsey et al. | 220/254.3 |
| 2007/0145055 | A1 * | 6/2007 | Gardiner | 220/254.4 |
| 2007/0164026 | A1 * | 7/2007 | Morrissey et al. | 220/254.3 |
| 2007/0215620 | A1 | 9/2007 | Kasper | |
| 2008/0053997 | A1 * | 3/2008 | Perra | 220/254.3 |
| 2008/0110887 | A1 | 5/2008 | Ramsey | |
| 2008/0314904 | A1 * | 12/2008 | Perra | 220/254.3 |
| 2009/0173737 | A1 | 7/2009 | Ramsey | |
| 2009/0179033 | A1 | 7/2009 | Ramsey | |

FOREIGN PATENT DOCUMENTS

| | | | |
|---|---|---|---|
| EP | 0305598 | A1 | 3/1989 |
| EP | 0 828 663 | B1 | 12/1999 |
| EP | 1767464 | | 3/2007 |
| FR | 1 434 827 | A | 6/1966 |
| GB | 2 154 561 | A | 9/1985 |
| GB | 2320008 | A | 6/1998 |
| JP | 61-48128 | | 5/1994 |
| JP | 2003-054549 | | 2/2003 |
| JP | 2003-112735 | | 4/2003 |
| KR | 2000-17742 | A | 4/2000 |
| WO | WO 91/10600 | | 7/1991 |
| WO | WO 95/04709 | | 2/1995 |
| WO | WO 96/09968 | | 4/1996 |
| WO | WO 98/36987 | | 8/1998 |
| WO | WO 01/28875 | A1 | 4/2001 |
| WO | WO 02/00512 | | 1/2002 |
| WO | WO 03/062084 | | 1/2003 |
| WO | WO 2007/039367 | A1 | 4/2007 |
| WO | WO 2007/128810 | | 11/2007 |
| WO | WO 2008/068169 | | 6/2008 |
| WO | WO 2008/054636 | | 7/2008 |
| WO | WO 2009/062004 | | 5/2009 |

OTHER PUBLICATIONS

U.S. Appl. No. 12/470,909, filed May 22, 2009, Ramsey.

Amtsblatt des Kantons Graubünden, "Hinged, resealable closures for metal can ends", 1996, 2746-2747.

U.S. Appl. No. 11/503,087: Final Rejection, Nov. 2, 2009.

U.S. Appl. No. 11/503,087: Non-Final Rejection, Jan. 22, 2009.

U.S. Appl. No. 11/591,041: Non-Final Rejection, Dec. 23, 2009.

U.S. Appl. No. 11/591,041: Requirement for Restriction/Election, Sep. 2, 2009.

English Translation of Abstract of JP 2003-112735, published on Apr. 18, 2003.

English Translation of Abstract of JP 2003-054549, published on Feb. 26, 2003.

English Translation of Abstract of JP 61-48128, published on May 27, 1994.

* cited by examiner

OPENING DEVICE

CROSS-REFERENCE TO RELATED APPLICATIONS

This application claims priority to EP06113767 filed May 10, 2006.

TECHNICAL FIELD

This invention relates to an opening device. In particular, but not exclusively, it relates to an opening device for use with a metal closure such as a can end or bottle cap.

BACKGROUND ART

U.S. Pat. No. 4,369,888 describes an opening device which forms the whole closure for a metal container. A neck part of the closure snaps around a locking shoulder on the container. A plug section is hinged to the neck part and is folded into the neck part to close the container. A vent hole in the plug section is closed by a lug on an integral ring pull, which is hinged to the plug at the opposite end to the plug-neck fulcrum.

The hinge between the ring pull and plug sections of the opening device of U.S. Pat. No. 4,369,888 is relatively fragile and may become detached during opening or before removal of the plug can be initiated. Furthermore, the opposing hinges require a high pull force if the plug is to be removed simply by pulling on a ring pull which is attached to the plug at the opposite end to the plug-neck fulcrum. In addition, the device requires special features on the can neck opening to which the closure neck part is directly fixed. The metal of the can body is very thin and the shoulder formed on the can body neck is subject to significant forces when the closure is opened which may deform the shoulder and compromise any seal for recloseability or risk the entire closure being removed from the container.

Continental Can's patent no. FR 1434827 describes a metal can end having a plastics opening device which has a tubular part in an opening of the can end. A tear strip is defined by a score between the tear strip and the tubular part, on the underside of the opening device and inside the container to which the device is attached. The tubular part is said to provide a bore seal with the can end opening and a peripheral edge on the tubular part opposes movement of the tubular part out of the can end opening. However, whilst this patent states that the opening device is easy to open, there is clearly a major risk of accidental opening due to premature tearing of the score or distortion of the plastics opening device when the container is dropped or mishandled in any way. Similarly, if the container is used for carbonated beverages, which are transported or maintained in high ambient temperatures, the soft plastic may deform or creep, leading to product leakage. Most importantly for the context of the present invention, once the opening device of FR 1434827 has been opened and the score broken, the device is not capable of reclosing to prevent spillage and maintain residual carbonation.

This invention seeks to provide an opening device which is capable of reclosing a container, which requires reduced opening force in comparison with the prior art and is easy to manufacture, assemble and operate. Furthermore, the opening device of the invention is adapted to use for packaging carbonated beverages and for use in hot countries. The opening device, whilst being easy to open and reclose, is configured so that creep of the plastic will tend to improve rather than compromise the sealing characteristics.

DISCLOSURE OF INVENTION

According to the present invention there is provided an opening device which comprises: a base plate and a tab which comprises a nose, and a handle at its distal end; in which the opening device is adapted, in use, to close an aperture in a metal closure panel, with the base plate on one side of the panel and the tab on the opposite side; and in which the base plate and/or tab further includes a wall which extends perpendicularly from the plate or tab respectively and provides an interference or friction fit with the edge of the aperture so as to seal around the perimeter of the closure aperture; characterised in that, when the opening device is used in combination with a metal closure having a metal closure panel, actuation of the tab translates into movement of the base plate, and the closure panel and opening device include complementary features for moving the opening device relative to the closure panel for opening or reclosing.

The can end of prior art FR 1434827 is not recloseable and cannot maintain carbonation after initial opening. The opening device and can end panel of the prior art do not include complementary features which are able to co-operate for opening without preventing reclosing the closure panel. The complementary features of the opening device of the present invention preferably comprise a cam profile on the closure panel and a cam follower on the base plate. Alternatively, the complementary features may comprise one or more rails on the closure panel and one or more grooves on the base plate, or vice versa. When the closure panel is a beverage can end, the cam profile may be provided by the underside of a circumferential bead such as a countersink adjacent chuck wall and seam.

In a preferred embodiment of the invention, the base plate includes a flange for co-operating with the underside face of the closure panel and providing sealing. The face seal is energised when the closure is in its closed position as pressure from product within the container builds up and may be reactivated when reclosed. The flange is particularly useful at elevated internal can pressure when the seal between the base plate wall and the aperture provides force to energise this face seal.

Ideally, the base plate includes a button which extends perpendicularly away from the base plate, and the tab includes a rivet hole, such that the tab is fixed to the base plate with the base plate on one side of the panel and the tab on the opposite side, by staking the button in the rivet hole to form a rivet. Alternative fixing features may be provided to connect the base plate and tab together.

In one embodiment, the tab includes a lug, which is adapted to extend through a complementary vent hole in the base plate or closure panel. This enables venting of can contents, prior to releasing of the primary seal between the base plate wall and aperture of the closure panel.

The tab may include one or more hinges for venting and/or re-closing. In one embodiment, the tab is hinged at its front, middle and sides so that during opening the back edge of the base plate moves downwardly away from the closure panel to vent, and during re-closing the back edge is levered up to re-engage the bore seal.

The combination of a metal closure and this opening device may use a tab profile which has a feature for functioning as a cam follower and a complementary feature on the closure which functions as a cam, or vice versa. For example, the closure may be a can end having a chuck wall which functions as the cam.

The opening device may be made as a single component, with the tab being inserted through the aperture and the base plate wall creating a bore seal. Alternatively, the base plate and tab may be separate components.

According to a further aspect of the present invention, there is provided a method of forming the closure and opening device combination, the method comprising: providing a one piece opening device having a tab part and a base plate part, inserting the tab part of the opening device through an aperture in the closure panel and engaging the edge of the aperture with the wall of the base plate so that the base plate is seated on the underside of the closure panel and the tab component above the panel. This method may include the steps of orienting the base plate on the underside of the closure aperture and the tab component above the aperture; inserting a button of the opening device through the rivet hole of the tab component, thereby trapping the closure panel therebetween; crushing and staking the button to form a rivet and fix the opening device onto the closure.

The orienting step may be achieved by inserting a flexible wall of the base plate through the closure aperture and thereby sealing the aperture. Additional sealing is provided between a flange of the base plate which co-operates with the underside face of the closure panel.

The metal closure may be a can end, cap or other closure which is not normally reclosable.

BRIEF DESCRIPTION OF DRAWINGS

Preferred embodiments of the invention will now be described, by way of example only, with reference to the drawings, in which.

MODE(S) FOR CARRYING OUT THE INVENTION

Figure 1:
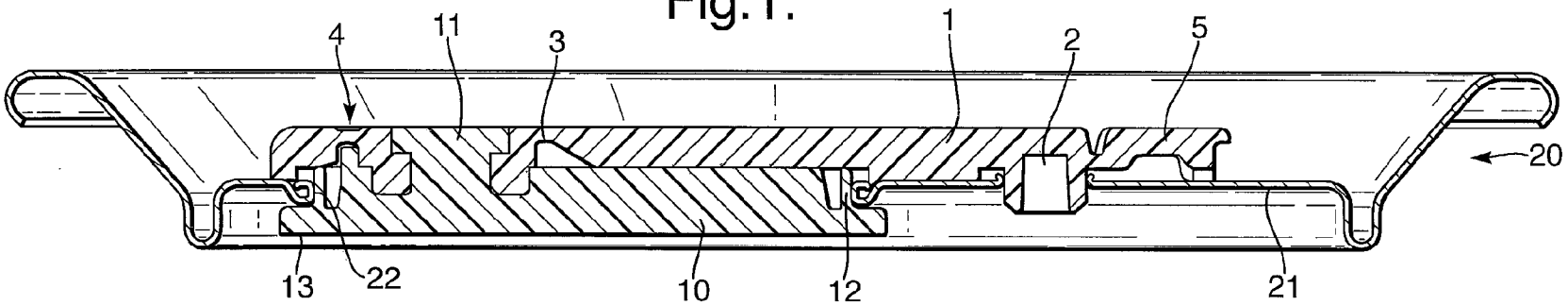
FIG. 1 is a side section of a closure fitted with the opening device of the invention, in closed position.

FIGS. 1 to 8 show an opening device according to a first embodiment of the invention, fitted to a metal can end 20. The opening device is of plastics material but this is not essential and one or more components of the device, such as the tab for example, could be of metal. The can end has a closure panel 21 in which an aperture has been formed and, in the embodiment shown, the edges of the aperture have been curled 22 so as to avoid exposure of cut edges of the metal. The opening device, which is of plastics material, comprises an upper part or top plate comprising tab 1, and a base plate 10 which provides a "top hat" seal with the aperture.

In FIG. 1, the opening device is shown in its closed position with tab 1 lying on an upper side of closure panel 21 of the can end. An optional pin 2 depends from tab 1 and is used as a retention device by engaging a vent hole 23 in the closure panel 21. This vent hole is optional depending on product within the can (i.e. internal pressure), properties such as thickness and flexibility of metal selected for the can end and ability to avoid metal exposure around the vent hole by curling etc. The tab has a primary hinge 3 and, in the embodiment of FIGS. 1 to 8, a secondary hinge 4, the operation of which is set out in detail below.

The primary function of base plate 10 is to provide an axial face seal between its sealing plate 13 and the underside of closure panel 21. This face seal is triggered by the lateral bore seal between flexible wall 12, which is spaced slightly inwardly from the periphery of the sealing plate, and the curled edge 22 of the closure panel aperture. The base plate is fixed to the tab by a rivet 11, which is formed integrally with the base plate.

Figure 2:
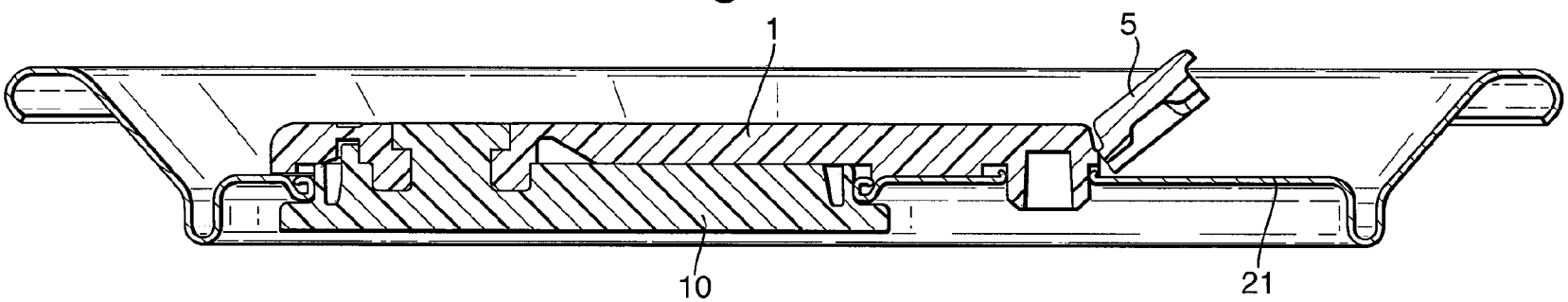
FIG. 2 is a like side section to that of FIG. 1, after breaking of a tab for tamper evidence.
Figure 3:
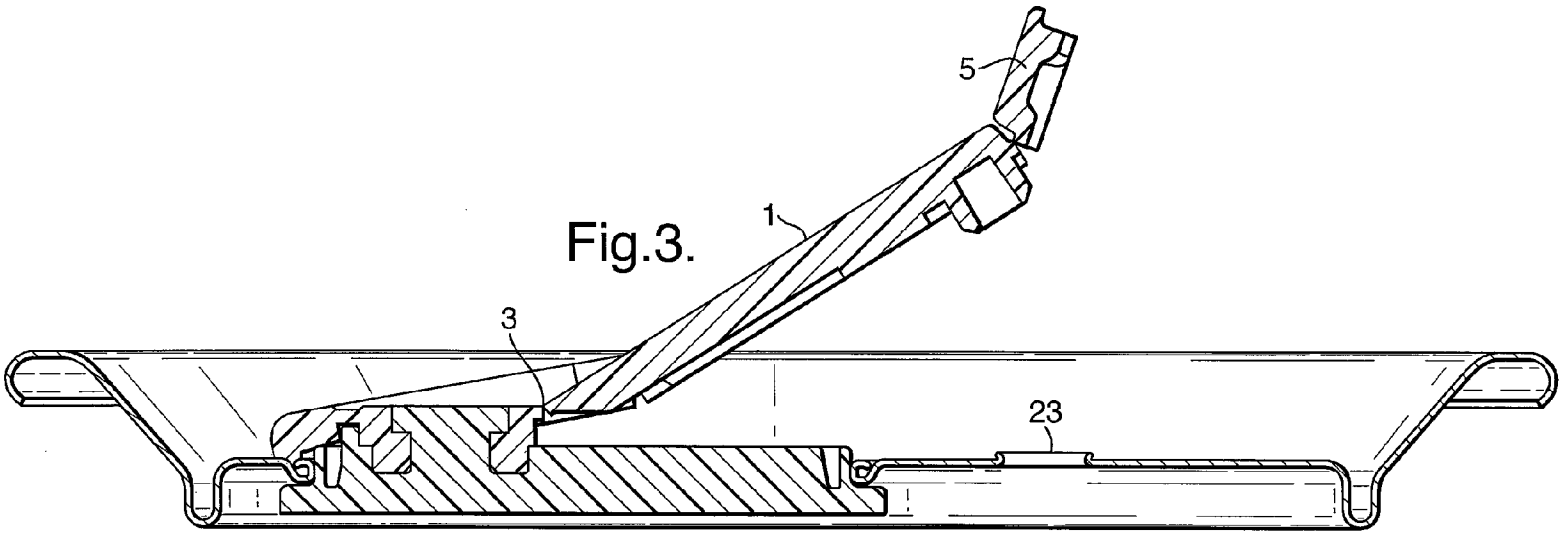
FIG. 3 is a like side section to that of FIGS. 1 and 2, after venting of a container to which the closure is fitted.

FIG. 2 shows the opening device with tamper evident feature 5 hinged ("broken") away from the closure panel 21. In FIG. 3, venting of the container is possible via vent hole 23 when the tab 1 is raised further by hinging at primary hinge 3. Such venting releases the internal pressure in the can body and reduces forces which seat the sealing plate 13 against the underside of the closure panel.

Figure 4:
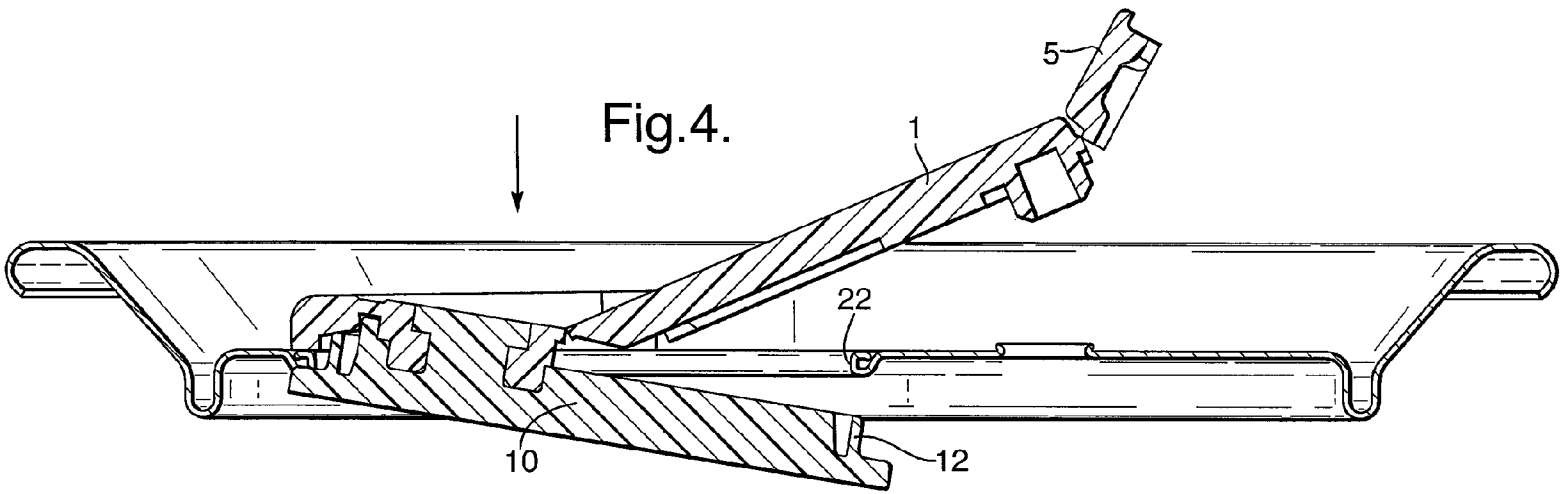
FIG. 4 is a like side section to that of FIGS. 1 to 3, after release of the base plate.
Figure 5:
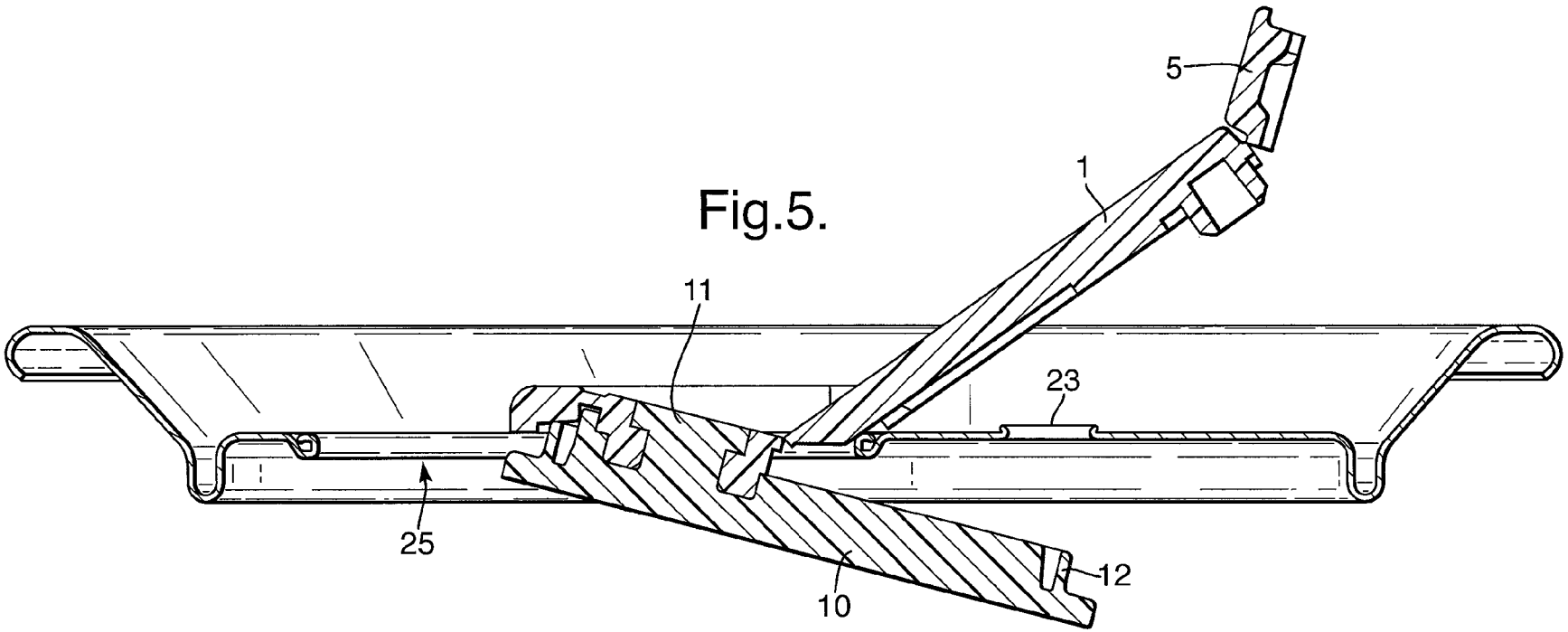
FIG. 5 is a like side section to that of FIGS. 1 to 4, after opening.

In order to open the can to which the end is fixed, the user presses down on the tab in the direction of the arrow (FIG. 4). This forces the base plate 10 away from the aperture into the disengaged position shown in FIG. 4 by hinging at secondary hinge 4. Pulling across the closure panel by the tab causes the closure to slide and thereby opens the can end exposing the pouring/dispensing aperture 25 as shown in FIG. 5.

Reclosing of the can is achieved by carrying out the above steps in reverse. Firstly the entire opening device is slid until its base plate is directly underneath the aperture 25. Lowering tab 1 causes the base plate to move upwardly and re-engage the edge of aperture 25 for closing. Since the tamper evident feature 5 has already been broken, this will remain in the position of FIG. 2, thus showing that the container has been opened at least once.

Figure 6:
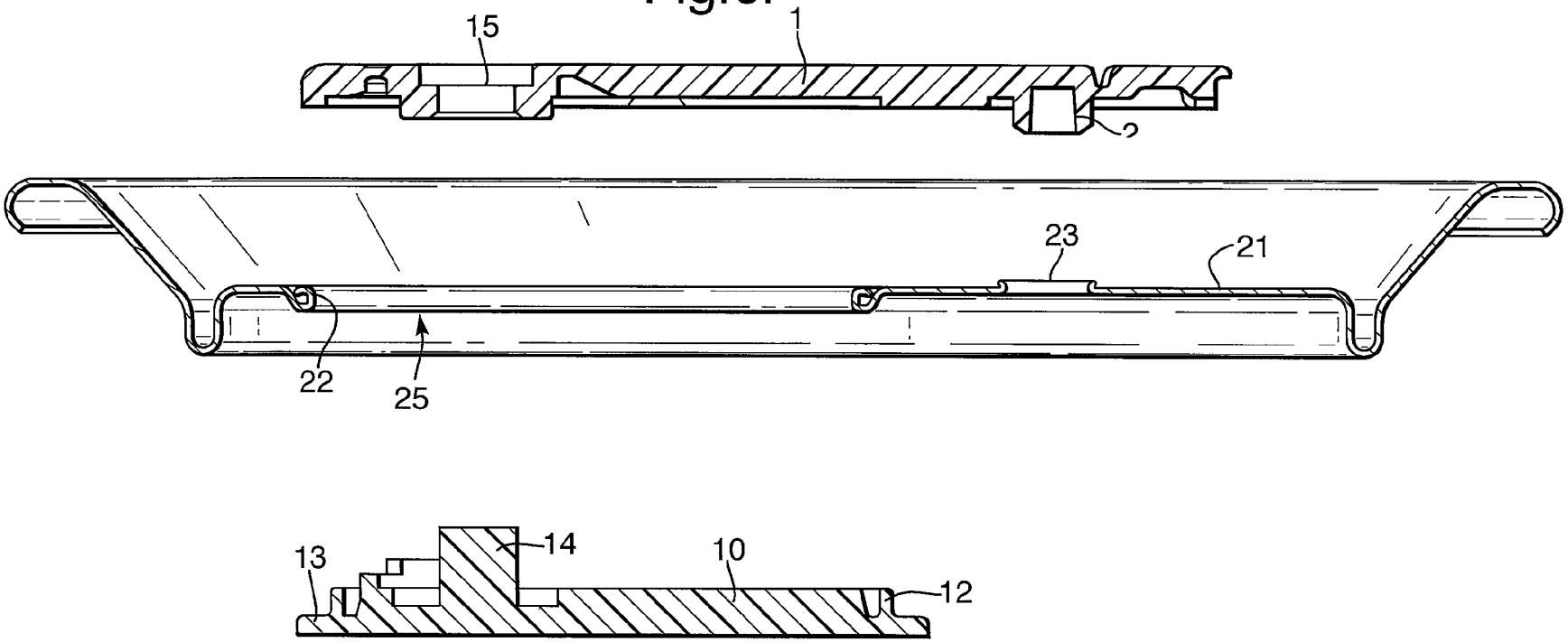
FIGS. 6 to 8 are side views showing assembly of the opening device onto a can end.
Figure 7:
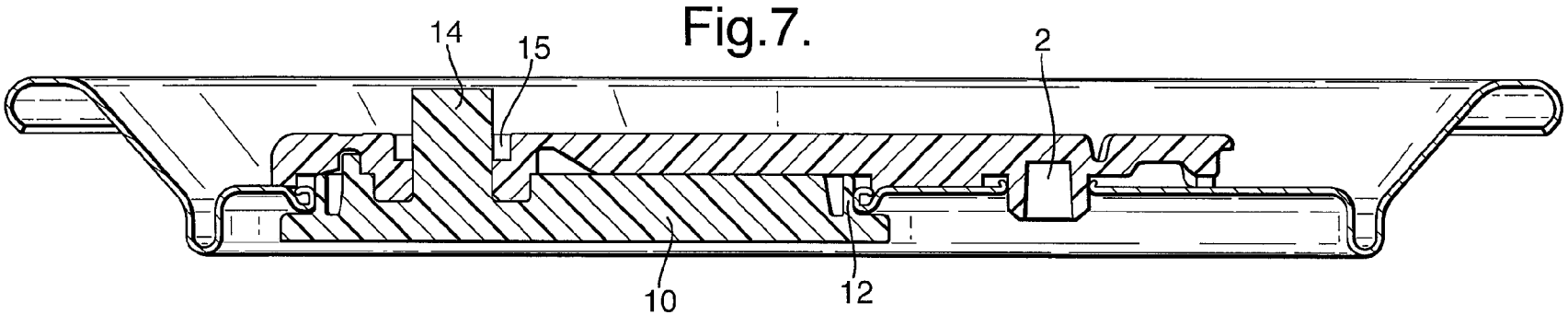
Figure 8:
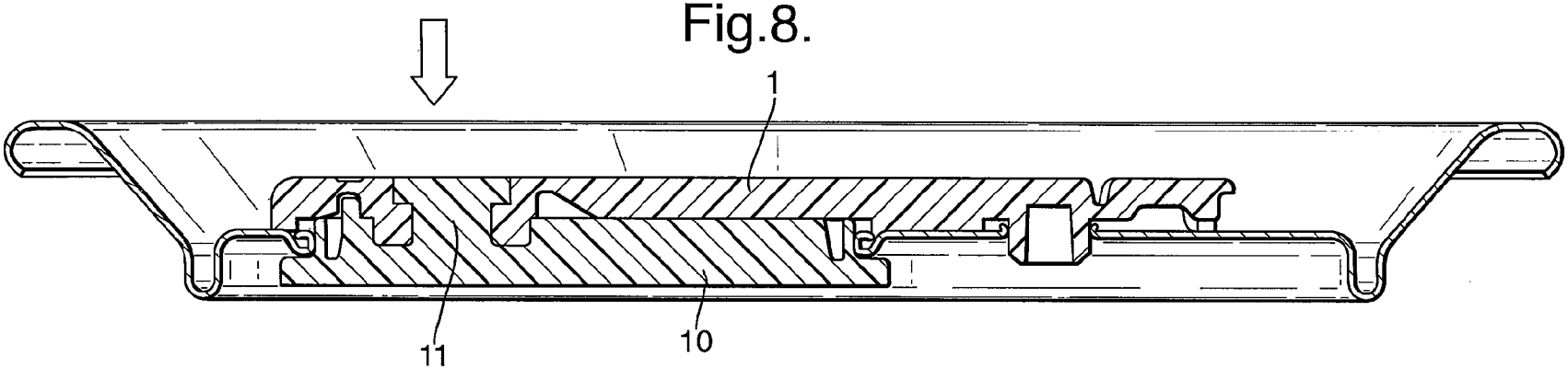

Steps for assembly of the recloseable can end can be seen from the assembly steps of FIGS. 6 through 8. FIG. 6 shows the relative positions of the separate components for orienting prior to assembly. In particular, the button 14 for forming rivet 11 is directly beneath profiled rivet hole 15 in the tab. Hole 15 has a lower cylindrical part, the diameter of which matches the button 14 and an upper part for staking the rivet.

Pin 2 of the tab 1 is directly above vent hole aperture 23 in the closure panel 21 of can end 20. The curl 22 around pouring/dispensing aperture 25 can be clearly seen in FIG. 6, as can the partial curl around vent hole 23.

In FIG. 7, the two parts of the opening device have been brought together and the button 14 inserted into rivet hole 15. Pin 2 engages vent hole 23. Finally, the rivet 11 is formed by staking, in which pressure applied in the direction of the arrow in FIG. 8 collapses the button 14 into the wider diameter part of rivet hole 15.

The embodiment of FIGS. 1 to 8 uses a sliding action to reciprocate between open and closed positions of the opening device. Clearly alternative reciprocating actions are also within the scope of the invention as defined by the claims. For example, in the embodiment of FIGS. 9 and 10 the base plate 10 and closure panel 21 include complimentary cam features 28, 29 such that rotation of the base plate 10 moves cam follower 28 along the cam profile 29 of the closure panel resulting in opening of the aperture 25. Alternative cam features could operate by lateral sliding of the base plate.

One alternative embodiment of cam opening can be seen from the embodiment shown in FIGS. 11 to 21.

Figure 11:
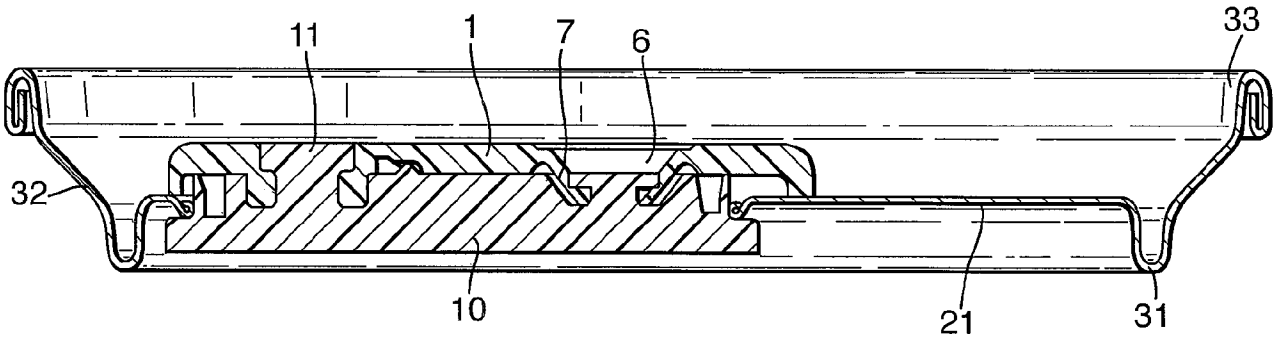
FIG. 11 is a side section of a closure fitted with a second embodiment of opening device of the invention, in closed position.
Figure 13:
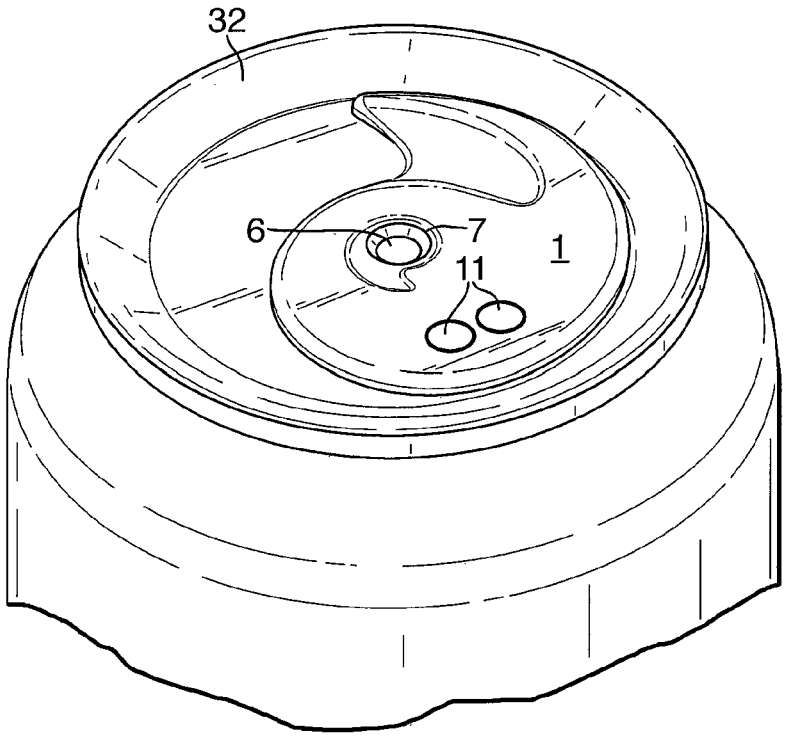
FIG. 13 is a perspective view of a can body fitted with the closure of FIGS. 11 and 12.

FIG. 11 is similar to FIG. 1 and shows the base, or sealing plate 10 under a can end closure panel 21. The base plate 10 is staked to the top plate 1 in order to form a pair of rivets 11 in the same manner as described for FIGS. 6 to 8. Rivet pair 11 forms a primary rivet, which fixes the tab (top plate) 1 to the sealing plate. As best seen in FIG. 13, rivet 11 may comprise more than one rivet, located around the centre of a chord. Alternatively, a single rivet at the centre of the chord, rivets at the ends of the chord or a single long connection between the base plate 10 and tab 1 is possible within the scope of the invention. Although rivets are preferred as a means of connection, other methods of fixing or bonding the base plate and tab together are possible within the scope of the invention.

In this embodiment, a second post on base plate 10 engages the top plate and is staked to form a tamper evident rivet 6. The tab 1 disengages from rivet 6 for opening, thereby providing tamper evidence. Aperture 7 includes a countersink in which the rivet head is disposed while the closure is in its fully closed position. The rivet head 6 is adapted to be pulled through the aperture when tab 1 is lifted for opening (see FIG. 14). The rivet 6 cannot then be re-inserted into the countersink after initial opening of the closure, even when the opening device is moved to reclose the pouring aperture. In this way tamper evidence is clear from the rivet 6 not being located in the countersink aperture 7.

Although not shown in the drawings, another type of tamper evidence could be provided by a thin web in the tab, with at least a part of the aperture 7 being formed in the web. The rivet would then be located in or above the web while the closure is in its fully closed position, and the web would be ruptured upon opening.

The can end 20 comprises closure panel 21 which extends into a circumferential countersink 31, chuck wall 32 and seaming panel 33. The seaming panel 33 is shown schematically in the figures in its fully curled position, as it would be when forming part of a double seam to join the closure to a can body. The reference numeral 33 is used for both the seaming panel and seam in the figures.

Figure 12:
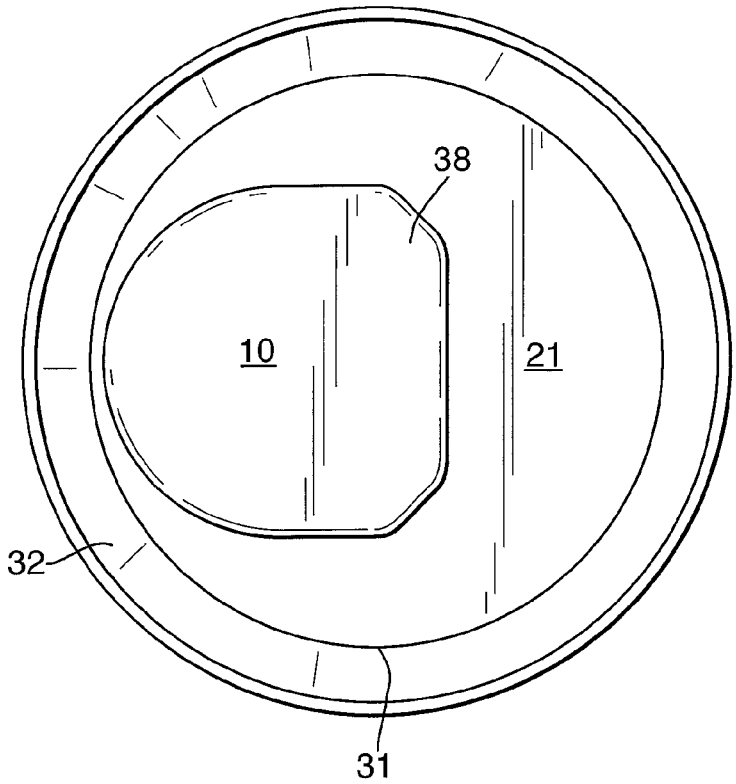
FIG. 12 is an underneath view of the closure of FIG. 11.

Referring now to FIG. 12, a cam follower 38 is formed by a "squared-off" portion of the base plate 10. Countersink 31 forms a cam profile so that rotation of the tab and base plate (fixed together by rivets 11) assists in progressive lowering of the base plate for venting gas pressure from within the container to which the closure is fixed. Venting and pouring is provided through a single hole.

Other features of the opening device/can end are used to form additional or alternative cam followers and cam profiles. For example as shown in FIG. 13, in which the can end 20 is shown seamed to a beverage can body, the tab has been provided with a profile which forms a cam follower 8 and the chuck wall angle provides a cam profile 32. The chuck wall 31 of the figures is inclined at an angle of about 45°. The can end 20 used in this example is of the type described in EP 0828663 B, which has a chuck wall angle of from 40° to 60°, although more upright, smaller angles are also possible within the scope of the invention. The shape of tab 1 in FIG. 13 suggests to the user that clockwise rotation is required to open the can.

Figure 16:
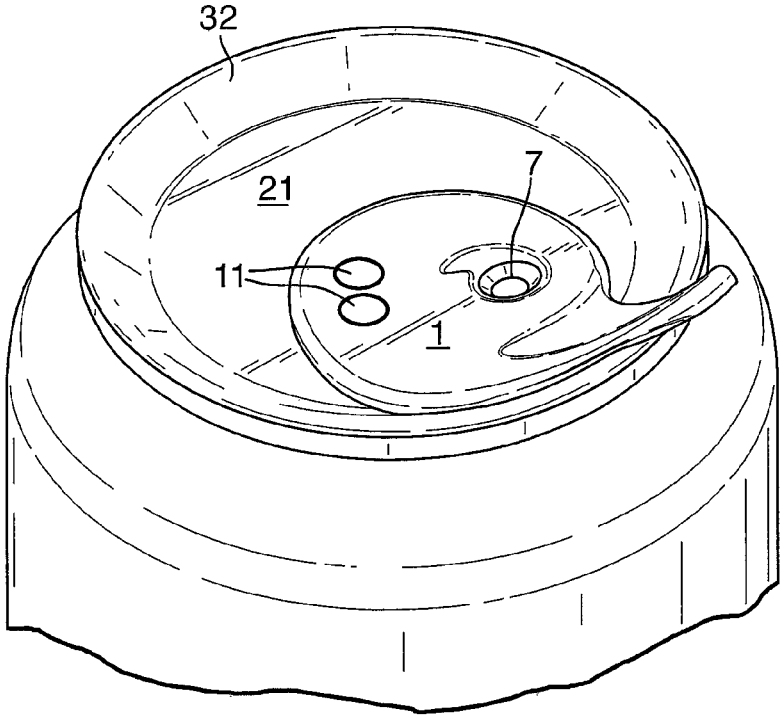
FIG. 16 is a perspective view of the closure of FIGS. 14 and 15, fitted to a can body.
Figure 14:
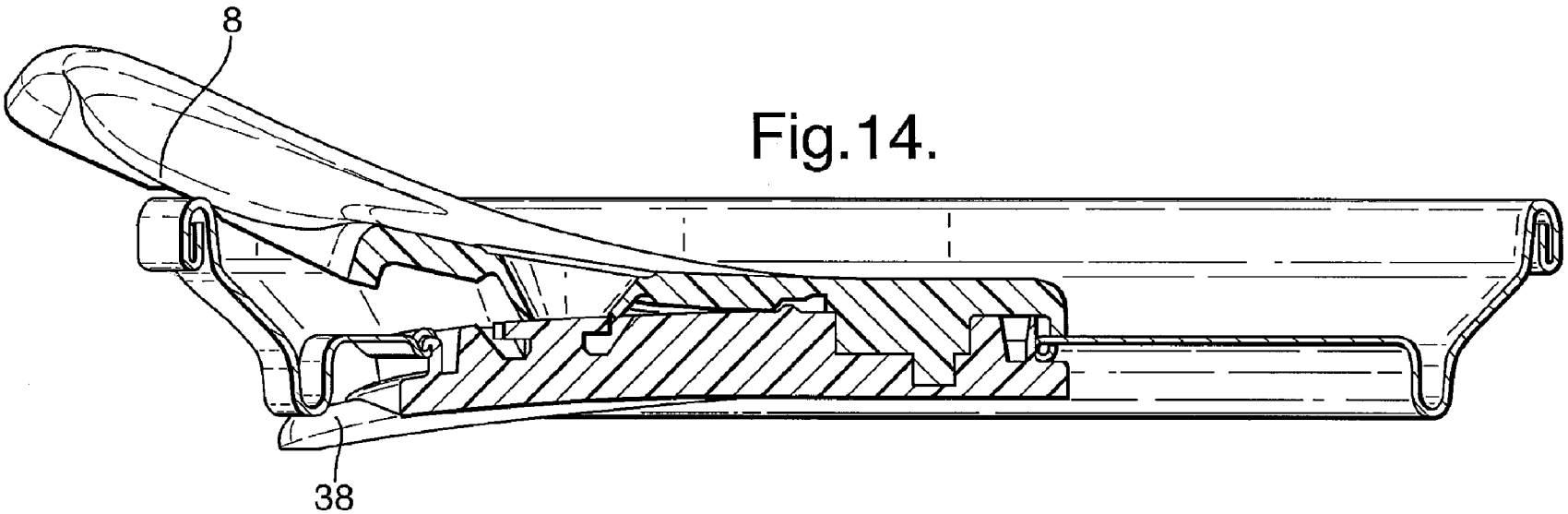
FIG. 14 is a side section of the closure of FIG. 11 during venting.
Figure 15:
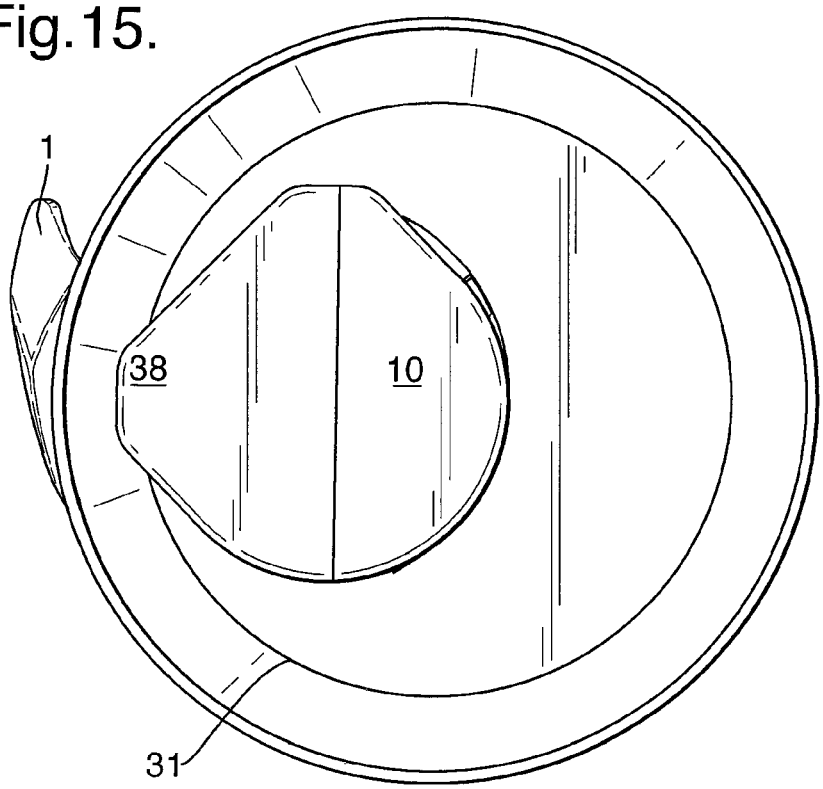
FIG. 15 is an underneath view of the closure of FIG. 14.
Figure 18:
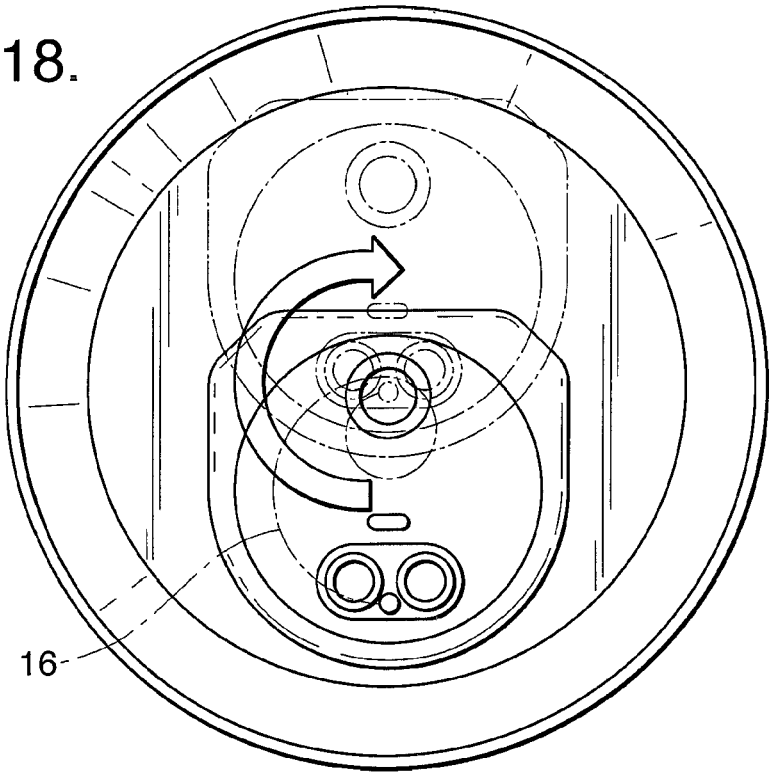
FIG. 18 is a schematic plan view showing opening movement of the opening device.

FIGS. 14 to 16 show tamper evidence actuation and venting. As best shown in FIG. 14, the tab is disengaged from tamper evident rivet 6, the tab 1 is rotated and the cam follower 8 at the apex of tab 1 follows the chuck wall 32. Simultaneously, cam follower 38 on base plate 10 follows the countersink 31 and creates a path for venting. The under plan view of FIG. 15 shows both tab 1 and base plate 10 in their vent positions.

Figure 17:
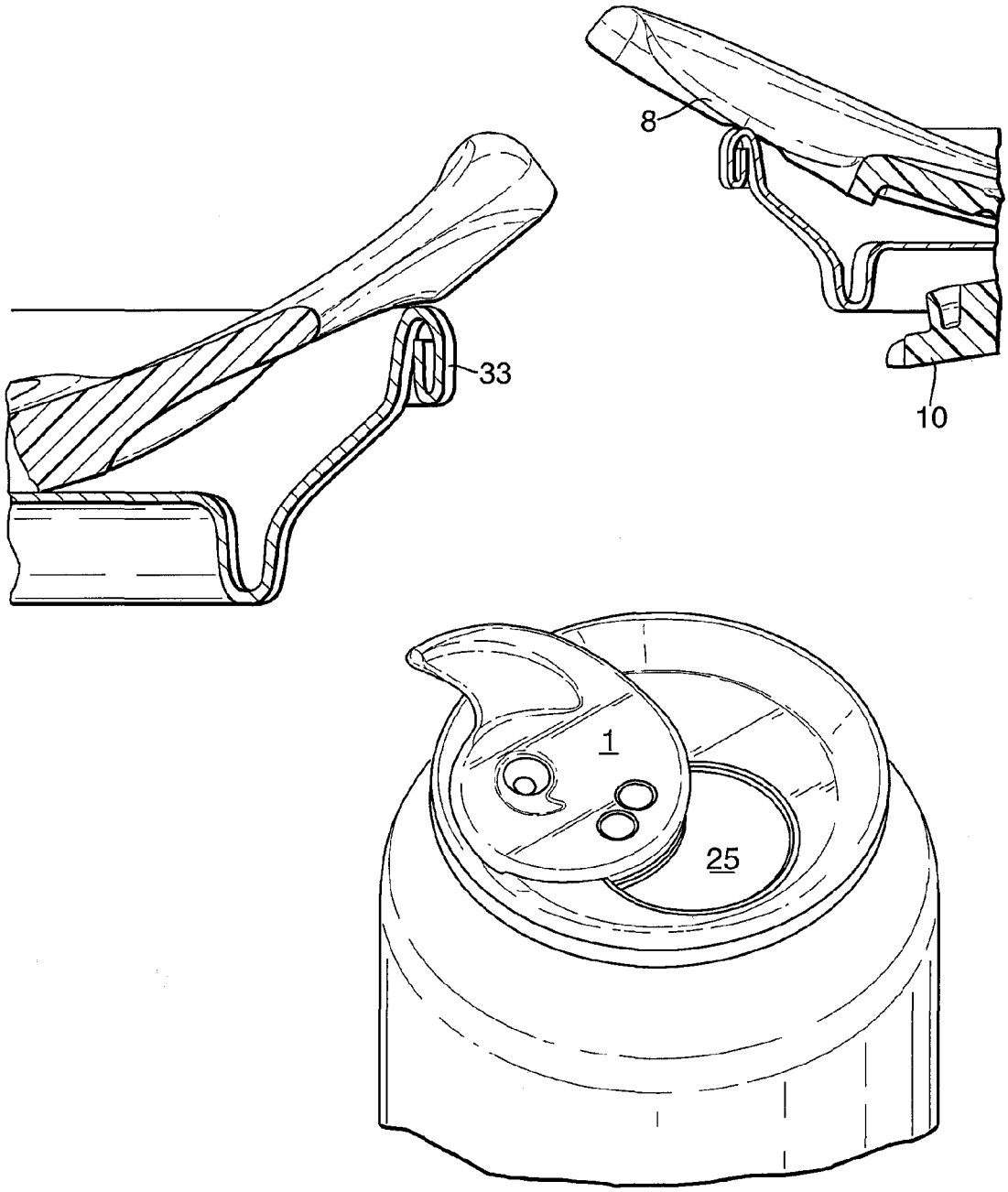
FIG. 17 comprises different views of the can body and closure during opening.

The cam follower 8 on tab 1 follows the chuck wall 32 onto seam 33 and the tab 1 thereby moves into the open position (FIG. 17). The movement of the centre point of the opening device during opening is denoted by the broad arrow in FIG. 18. By having the pouring aperture 25 close to the closure panel edge, cam action is assisted. The front rivets 11 follow the path 16 shown by the narrower 'spiral' line.

Figure 19:
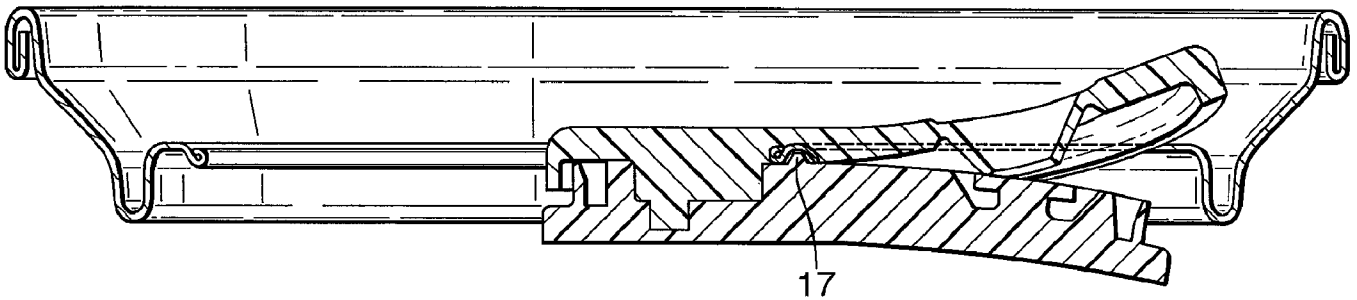
FIG. 19 is a side view of the opening device in its open position.
Figure 20:
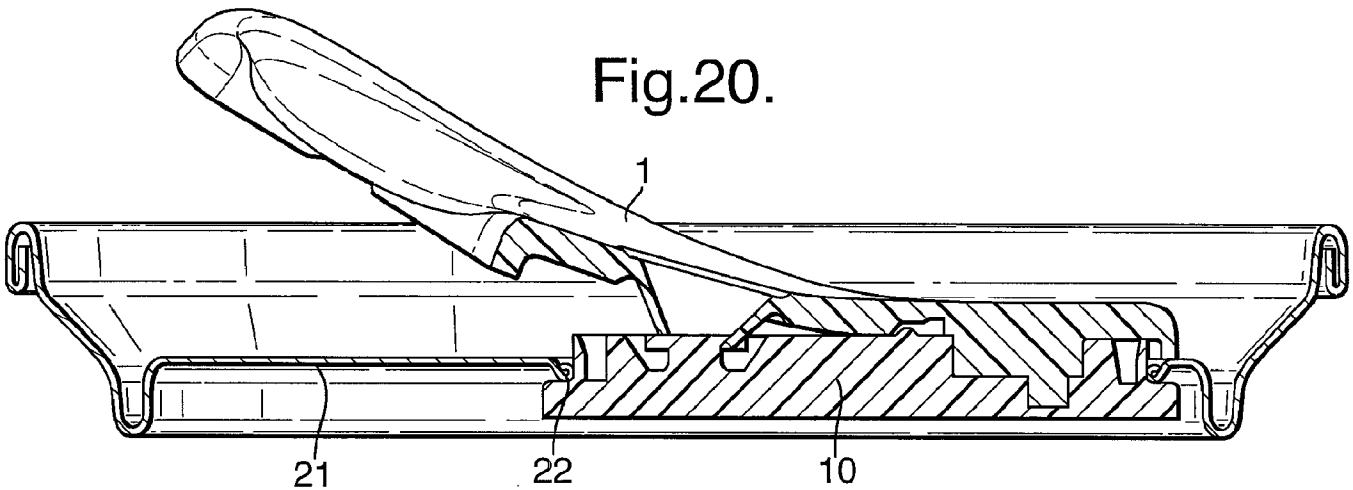
FIG. 20 is a side view of the closure during reclosing of the opening device.

In order to maintain the opening device in its open position, a lug 17 on base plate 10 clips over the edge of dispensing aperture 25 as shown in FIG. 19. Lifting of the tab disengages this lug by tilting the base plate and the opening device may then be slid back into the aperture 24.

The opening device of the present invention is particularly adapted for reclosing by lifting the tab so that the base plate wall re-engages the interference fit with the edge 22 of the closure panel aperture. In particular, the base plate flange then contacts the underside of the closure panel to re-establish a face seal. This face seal is further assisted by residual carbonation of product in the re-closed can: by reclosing the opening device of the present invention to re-establish both bore and face seals, residual carbonation is maintained and allows pressure to build up to maintain the base plate in its closed position. Any remaining beverage in the re-closed container will not spill, even if the container is tipped over.

Figure 9:
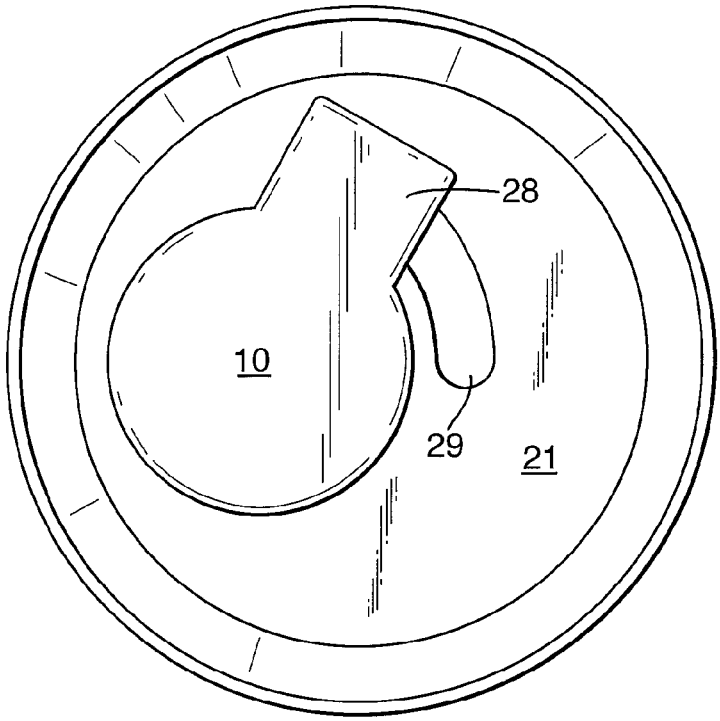
FIG. 9 is an underneath view of a can end with a cam profile.
Figure 10:
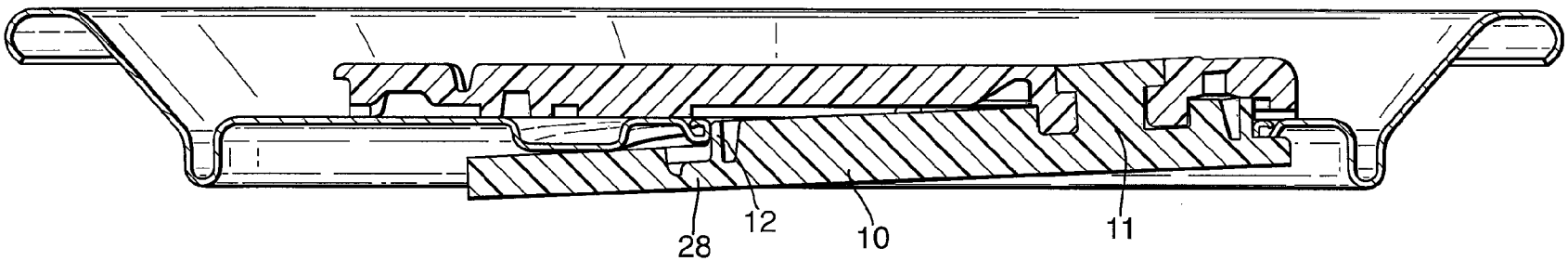
FIG. 10 is a side section of the can end of FIG. 9.

Cam profiles according to this invention may be formed by both the countersink and chuck wall/seam as in FIGS. 11 to 21, discrete features as in FIGS. 9 and 10, or by only a single cam on either the base plate side or the tab side of the closure.

Although the invention has been described above with reference to a metal can end, the opening device could be used to close and reclose other metal closures, such as a bottle cap.

The invention claimed is:

1. An opening device capable of closing an aperture in a metal panel, the opening device comprising:

a base plate configured to be located on an underside of the metal panel;

a tab configured to be located on a topside of the metal panel, the tab capable of actuation to translate the opening device relative to the panel aperture;

at least one of the base plate and the tab including a perpendicularly extending wall, the wall being configured to contact an edge of the panel aperture in an interference or friction fit to form a seal about the perimeter of the panel aperture; and a means for guiding the opening device at least partially along a diameter of the metal panel for opening and reclosing.

2. The opening device of claim 1, wherein the means for guiding comprises a first cam follower on the base plate configured to interface with a first cam profile on the panel.

3. The opening device of claim 1, wherein the means for guiding comprises one or more grooves on the base plate configured to interface with one or more rails on the panel.

4. The opening device of claim 1, wherein the means for guiding comprise one or more rails on the base plate configured to interface with one or more grooves on the panel.

5. The opening device of claim 1, wherein (i) the base plate includes a flange configured to co-operate with the underside face of the panel to thereby provide a seal, the seal being energized when internal pressure builds up, when the device is in its closed position.

6. The opening device of claim 5, wherein the seal is configured to be reactivated when the device is reclosed.

7. The opening device of claim 1, wherein the base plate includes a button which extends perpendicularly away from the base plate, and the tab includes a rivet hole, such that the tab is fixed to the base plate with the base plate configured to be on one side of the panel and the tab on the opposite side, by staking the button in the rivet hole to form a rivet.

8. The opening device of claim 1, wherein the tab includes a lug which is configured to extend through a complementary vent hole in the base plate or panel.

9. The opening device of claim 1, wherein the tab includes one or more hinges for venting and/or re-closing.

10. The opening device of claim 1, wherein the tab includes a handle and an opposing nose.

11. A can end combination comprising a metal can end and a resealable closure coupled to the can end, the can end comprising a peripheral wall and a center panel, the center panel including an upper surface, an opposing lower surface, and an aperture formed therethrough;

the closure comprising a base plate and a top plate coupled to the top plate at a first location, the closure configured to have a sealed position in which at least one of the base plate and top plate form a bore seal and a face seal about the aperture, an intermediate position in which the closure is proximate the aperture but not sealed, and a fully open position in which the aperture is exposed to enable pouring liquid through the aperture;

wherein (i) the base plate is downwardly moveable from the sealed position to the intermediate position, (ii) the base plate and top plate are configured to translate together at least partially along a diameter of the can end center panel from the intermediate position to the fully open position, (iii) the base plate and top are configured to translate together relative to the can end center panel from the fully open position back to the intermediate position, and (iv) the base plate is upwardly moveable into engagement with the center panel from the intermediate position into a resealed position forming the bore seal and the face seal.

12. A can end combination comprising a metal can end and a resealable closure coupled to the can end, the can end comprising a peripheral wall and a center panel, the center panel including an upper surface, an opposing lower surface, and an aperture formed therethrough;

the closure comprising a base plate and a top plate, the base plate including a continuous flange for forming a face seal with the lower surface of the center panel and a continuous upright ring for forming a bore seal with a lip of the aperture, wherein (i) each one of the face seal and the bore seal are disengageable, (ii) the base plate and the top plate are configured to slide to uncover the aperture after disengagement of the face seal and the bore seal, and (iii) the base plate and the top plate are configured to then slide back to reseal the closure.

13. The can end combination of claim 12, complementary features on the center panel and base plate for moving the opening device relative to the panel for opening and reclosing.

14. The can end combination of claim 13, wherein the center panel includes a first cam profile and the base plate includes a first cam follower.

15. The can end combination of claim 13, wherein the complementary features comprise one or more rails on the panel and one or more grooves on the base plate.

16. The can end combination of claim 13, wherein the complementary features comprise one or more rails on the base plate and one or more grooves on the panel.

17. The can end combination of claim 13, wherein the base plate includes a flange for co-operating with the underside face of the panel and providing sealing, the seal being configured to be energized when internal pressure builds up when the closure is in its sealed position.

18. The can end combination of claim 17, wherein the seal is configured to be reactivated when the closure is resealed.

19. The can end combination of claim 12, wherein the base plate includes a button which extends perpendicularly away from the base plate, and the tab includes a rivet hole, such that the tab is fixed to the base plate with the base plate on one side of the panel and the tab on the opposite side, by staking the button in the rivet hole to form a rivet.

20. The can end combination of claim 12, wherein the tab includes a lug which is configured to extend through a complementary vent hole in the base plate or panel.

21. The can end combination of claim 12, wherein the tab includes one or more hinges for venting and/or re-sealing.

22. The can end combination of claim 12, wherein the tab includes a handle and an opposing nose.

* * * * *

UNITED STATES PATENT AND TRADEMARK OFFICE

CERTIFICATE OF CORRECTION

PATENT NO. : 7,918,359 B2
APPLICATION NO. : 11/747049
DATED : April 5, 2011
INVENTOR(S) : Alexandre Paris, Mark James LeFeuvre and Christopher Paul Ramsey It is certified that error appears in the above-identified patent and that said Letters Patent is hereby corrected as shown below:

Column 7,
Line 29, delete "top" and insert -- base --.

Signed and Sealed this
Tenth Day of April, 2012

David J. Kappos

David J. Kappos
*Director of the United States Patent and Trademark Office*